US011688936B2

(12) United States Patent
Wu et al.

(10) Patent No.: US 11,688,936 B2
(45) Date of Patent: Jun. 27, 2023

(54) ANTENNA MODULE

(71) Applicant: PEGATRON CORPORATION, Taipei (TW)

(72) Inventors: Chien-Yi Wu, Taipei (TW); Shih-Keng Huang, Taipei (TW); Chao-Hsu Wu, Taipei (TW); Sheng-Chin Hsu, Taipei (TW); Chien-Chih Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/469,787

(22) Filed: Sep. 8, 2021

(65) Prior Publication Data

US 2022/0123461 A1 Apr. 21, 2022

(30) Foreign Application Priority Data

Oct. 21, 2020 (TW) ..... 109136489

(51) Int. Cl.

| | |
|---|---|
| ***H01Q 1/48*** | (2006.01) |
| ***H01Q 21/00*** | (2006.01) |
| ***H01Q 1/24*** | (2006.01) |

(52) U.S. Cl.

CPC ..... *H01Q 1/48* (2013.01); *H01Q 21/0025* (2013.01); *H01Q 1/242* (2013.01)

(58) Field of Classification Search

CPC ..... H01Q 1/48; H01Q 5/35; H01Q 1/521

See application file for complete search history.

(56) References Cited

U.S. PATENT DOCUMENTS

| | | | | |
|---|---|---|---|---|
| 2017/0084997 | A1* | 3/2017 | Wu | H01Q 1/50 |
| 2020/0058992 | A1* | 2/2020 | Wu | H01Q 1/48 |
| 2020/0106178 | A1* | 4/2020 | Chou | H01Q 1/2291 |

FOREIGN PATENT DOCUMENTS

| | | | | |
|---|---|---|---|---|
| CN | 209088056 | | 7/2019 | |
| CN | 112838369 | A * | 5/2021 | H01Q 1/36 |
| CN | 112928468 | A * | 6/2021 | H01Q 1/245 |
| EP | 3683890 | A1 * | 7/2020 | H01Q 1/2291 |
| TW | M435740 | | 8/2012 | |
| TW | 201541708 | | 11/2015 | |
| TW | 201728007 | A * | 8/2017 | |
| TW | 579391 | U * | 6/2019 | H01Q 1/2291 |
| TW | 201941490 | | 10/2019 | |

* cited by examiner

*Primary Examiner* — Ricardo I Magallanes
(74) *Attorney, Agent, or Firm* — J.C. Patents

(57) ABSTRACT

An antenna module, including a first antenna, a second antenna, a first ground, a third antenna, and a second ground, is provided. The first ground is located between the first antenna and the second antenna and is connected to the first antenna and the second antenna. The first ground has a first slot near the first antenna. The second antenna is located between the first antenna and the third antenna. An extension direction of the first antenna is not parallel to an extension direction of the second antenna. The extension direction of the second antenna is not parallel to an extension direction of the third antenna. The second ground is located between the second antenna and the third antenna and is connected to the third antenna. The second ground is separated from the first ground and the second antenna, and has a second slot.

9 Claims, 8 Drawing Sheets

ANTENNA MODULE

CROSS-REFERENCE TO RELATED APPLICATION

This application claims the priority benefit of Taiwan application serial no. 109136489, filed on Oct. 21, 2020. The entirety of the above-mentioned patent application is hereby incorporated by reference herein and made a part of this specification.

BACKGROUND

Technical Field

The disclosure relates to an antenna module, and particularly relates to an antenna module with good isolation between antennas and good antenna efficiency.

Description of Related Art

The fifth-generation (5G) mobile communication requires multiple antennas to be placed in the same axial direction. How to have good isolation between the antennas and good antenna efficiency is the goal in the art.

SUMMARY

The disclosure provides an antenna module with good isolation between antennas and good antenna efficiency.

An antenna module of the disclosure includes a first antenna, a second antenna, a first ground, a third antenna, and a second ground. The first ground is located between the first antenna and the second antenna and is connected to the first antenna and the second antenna. The first ground has a first slot near the first antenna. The second antenna is located between the first antenna and the third antenna. An extension direction of the first antenna is not parallel to an extension direction of the second antenna. The extension direction of the second antenna is not parallel to an extension direction of the third antenna. The second ground is located between the second antenna and the third antenna and is connected to the third antenna. The second ground is separated from the second antenna and the first ground. The second ground has a second slot.

In an embodiment of the disclosure, the antenna module further includes a first retaining wall and a second retaining wall. The first retaining wall is vertically disposed on the first ground and near the first slot and is conducted with the first ground. The second retaining wall is vertically disposed on the first ground and near the second antenna and is conducted with the first ground. The first retaining wall and the second retaining wall are located between the first antenna and the second antenna.

In an embodiment of the disclosure, the antenna module further includes a metal member, which is disposed on one side of the first ground and is separated from the first ground. The second ground extends to the metal member. The first ground is connected to the metal member by a conductive member.

In an embodiment of the disclosure, the first retaining wall is located between the first antenna and the first slot or the first slot is located between the first antenna and the first retaining wall.

In an embodiment of the disclosure, the second antenna includes a primary radiator and a secondary radiator. The primary radiator and the secondary radiator are separated from each other and are both connected to the first ground. The secondary radiator is near a feeding end of the primary radiator. The primary radiator and the secondary radiator extend along different directions.

In an embodiment of the disclosure, an angle between the extension direction of the first antenna and an extension direction of the primary radiator of the second antenna is between 45 and 75 degrees, and an angle between the extension direction of the primary radiator of the second antenna and the extension direction of the third antenna is between 45 and 75 degrees.

In an embodiment of the disclosure, an extension direction of the first slot is parallel to an extension direction of the second slot.

In an embodiment of the disclosure, a length of the first slot is between 12 mm and 15 mm, a width of the first slot is between 4 mm and 6 mm, a length of the second slot is between 22 mm and 26 mm, and a width of the second slot is between 0.5 mm and 1.5 mm.

In an embodiment of the disclosure, a distance between the first antenna and the second antenna is between 80 mm and 100 mm, and a distance between the second antenna and the third antenna is between 15 mm and 20 mm.

In an embodiment of the disclosure, the antenna module further includes a fourth antenna and a third ground. The first antenna is located between the fourth antenna and the second antenna. An extension direction of the fourth antenna is different from the extension direction of the first antenna. The third ground is located between the fourth antenna and the first antenna. The third ground has a third slot.

Based on the above, the extension direction of the first antenna of the antenna module according to the disclosure is not parallel to the extension direction of the second antenna, and the extension direction of the second antenna is not parallel to the extension direction of the third antenna. In addition, the first ground located between the first antenna and the second antenna has the first slot, and the second ground located between the second antenna and the third antenna has the second slot. The above configuration may effectively increase the isolation among the first antenna, the second antenna, and the third antenna, and enable the first antenna, the second antenna, and the third antenna to have good antenna efficiency.

DETAILED DESCRIPTION OF DISCLOSED EMBODIMENTS

Figure 1:
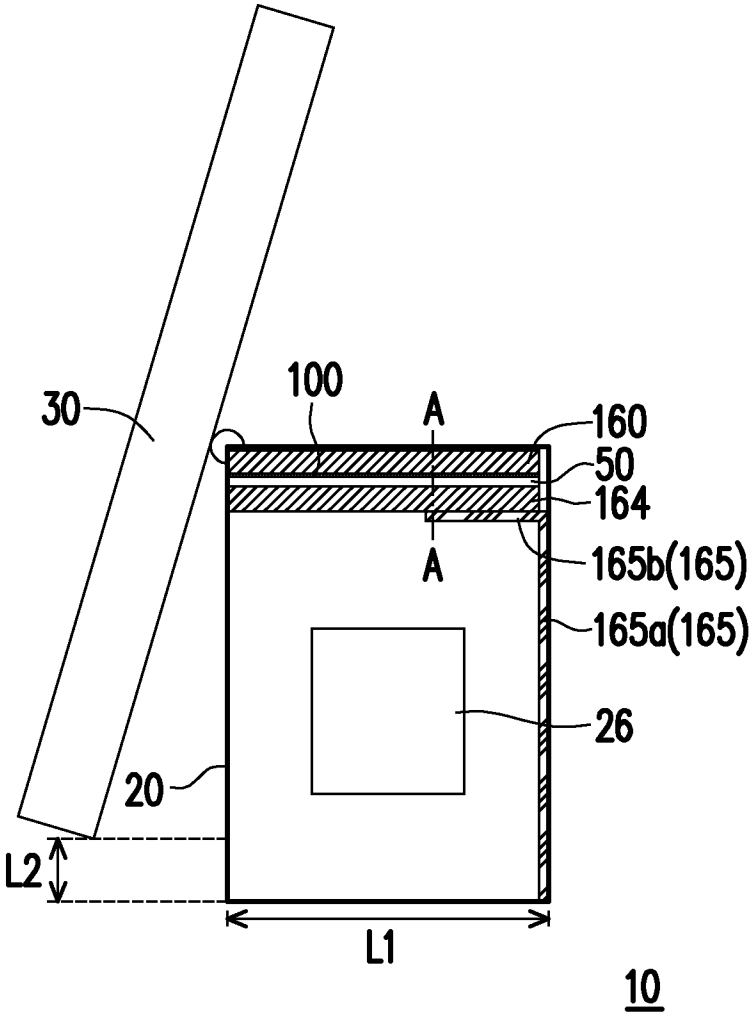
FIG. 1 is a schematic view of an electronic device according to an embodiment of the disclosure.
Figure 2:
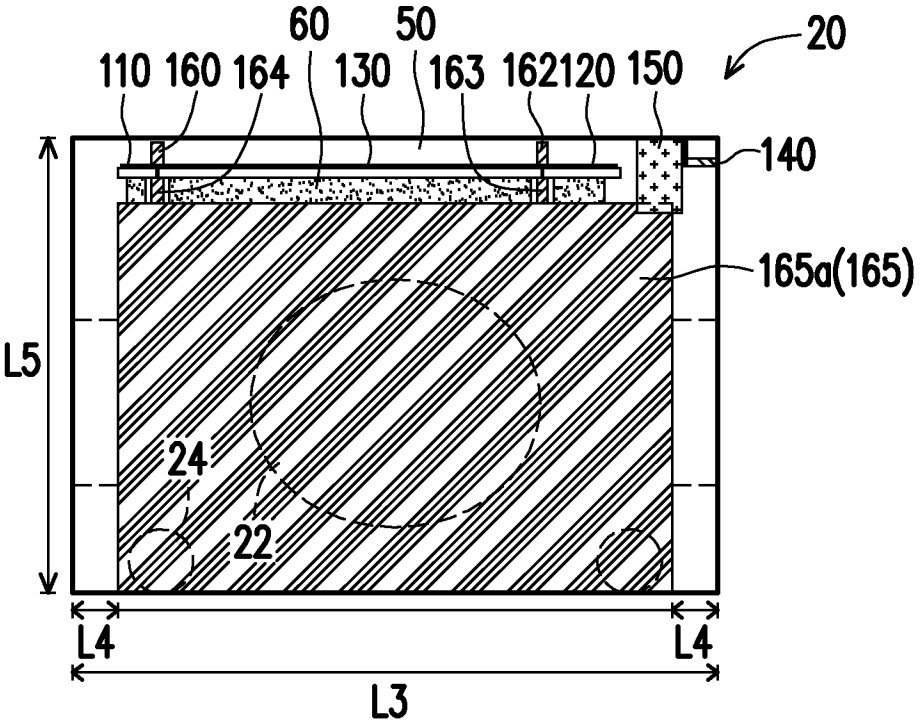
FIG. 2 is a schematic cross-sectional view of a host body of the electronic device of FIG. 1.

FIG. 1 is a schematic view of an electronic device according to an embodiment of the disclosure. FIG. 2 is a schematic view of a host body of the electronic device of FIG. 1 from another perspective. It should be noted that in order to clearly show the relevant structures of the antenna module, in FIG. 1 and FIG. 2, the relevant structures of the antenna module are represented by solid lines. In addition, FIG. 2 only shows the host body and omits a screen.

Please refer to FIG. 1 and FIG. 2. An electronic device 10 of this embodiment is exemplified by a smart loudspeaker, but the type of the electronic device 10 is not limited thereto. The electronic device 10 includes a host body 20 and a screen 30. The screen 30 is slightly higher than the bottom of the host body 20, and a height L2 (FIG. 1) from the bottom of the host body 20 is greater than or equal to 15 mm, but not limited thereto.

As shown in FIG. 2, the host body 20 includes a low-frequency speaker cavity 22 located in the center, a low-frequency speaker 26 (with a width L4 of approximately 20 mm) located on two sides of the host body 20, and a high-frequency speaker cavity 24 located on the lower side of the host body 20.

In this embodiment, since the screen 30 has a narrow bezel, there is no extra space for the antenna module 100 (FIG. 3), and the antenna module 100 needs to be disposed in the host body 20. A thickness L1 (FIG. 1) of the host body 20 is approximately 47 mm, a width L3 is approximately 240 mm, and a height L5 is approximately 120 mm. In such a small-sized host body 20, the antenna module 100 has a special design to have good isolation and antenna efficiency. The structure of the antenna module 100 will be elaborated as follows.

Figure 3:
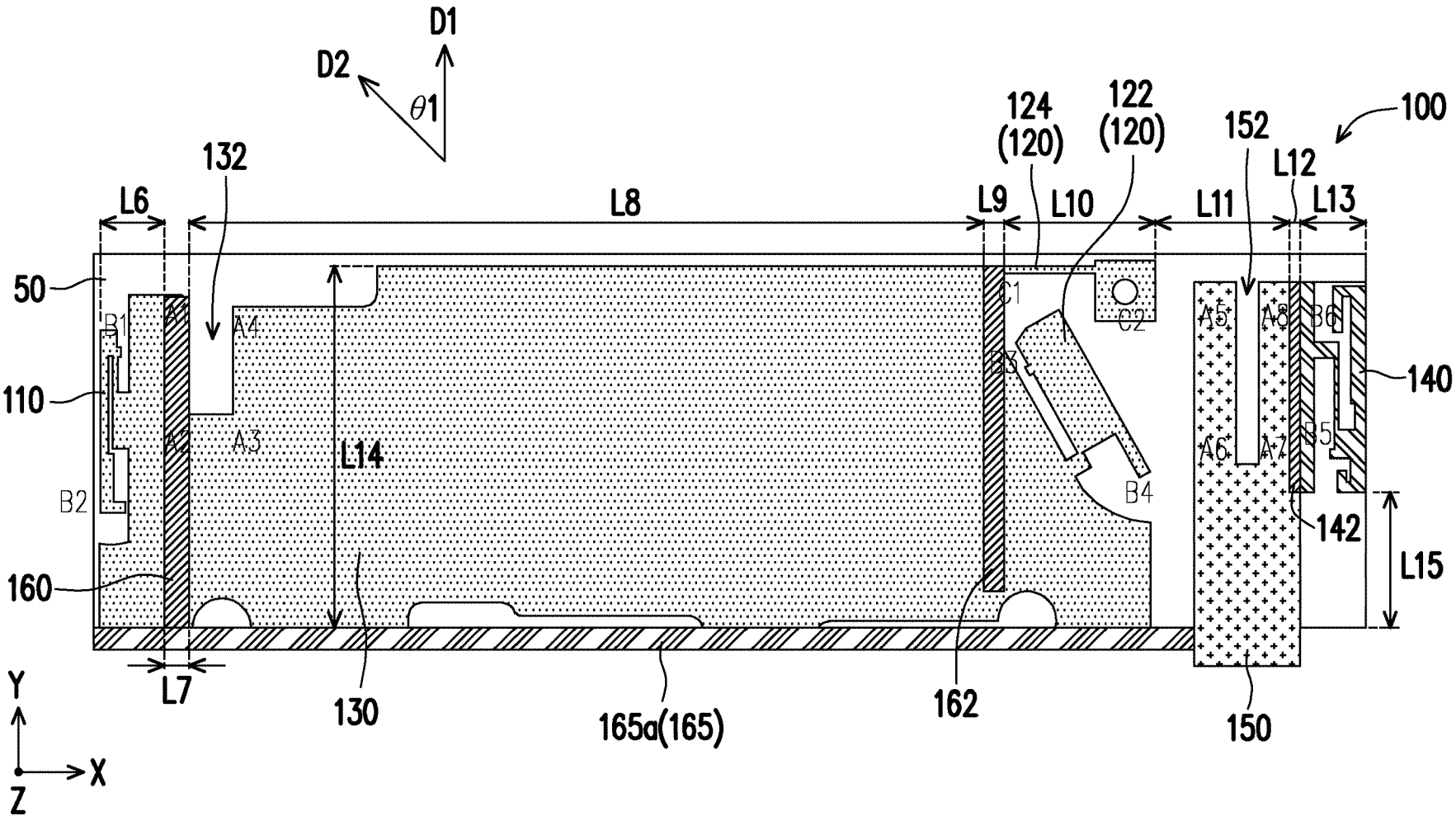
FIG. 3 is a schematic top view of an antenna module according to an embodiment of the disclosure.
Figure 4:
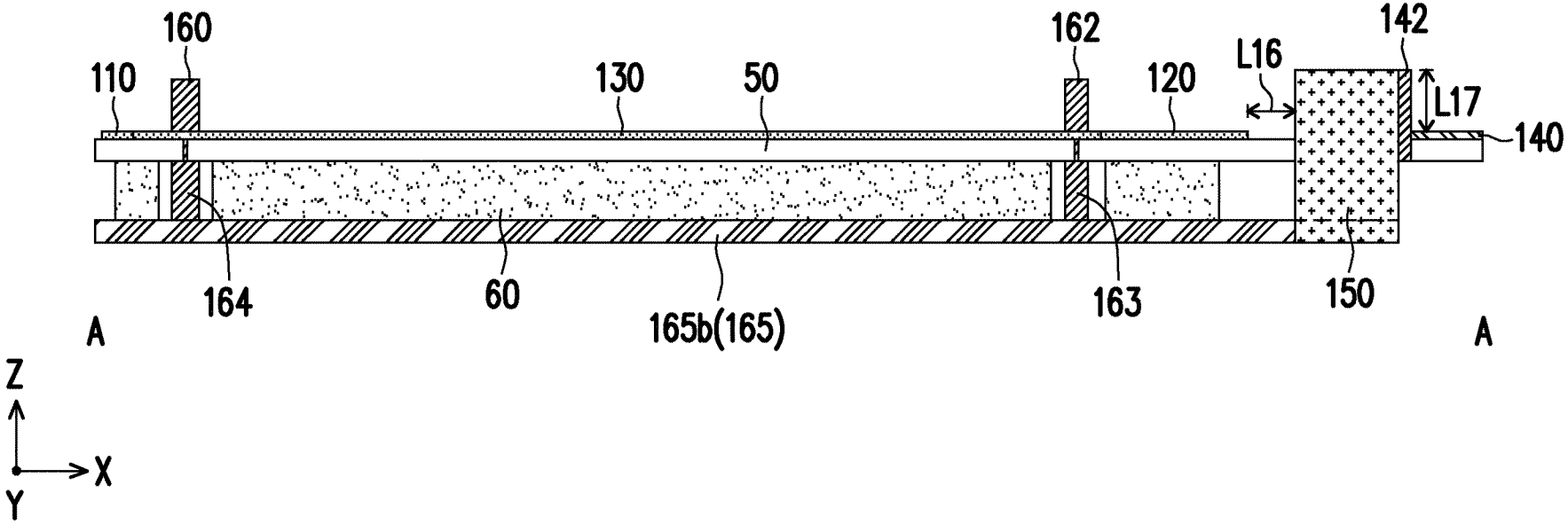
FIG. 4 is a schematic cross-sectional view taken along a line segment A-A of FIG. 1.

FIG. 3 is a schematic top view of an antenna module according to an embodiment of the disclosure. FIG. 4 is a schematic cross-sectional view taken along a line segment A-A of FIG. 1. It should be noted that FIG. 4 is also a side view of FIG. 3. The relative positions of FIG. 3 and FIG. 4. may be referred to the coordinates X-Y-Z.

Please refer to FIG. 3 and FIG. 4. In this embodiment, the antenna module 100 is disposed on a substrate 50 and includes a first antenna 110, a second antenna 120, a first ground 130, a third antenna 140, and a second ground 150. The substrate 50 is, for example, a motherboard (FIG. 3 only shows a portion of the substrate), but is not limited thereto.

In this embodiment, the first antenna 110 is a Bluetooth antenna, and the feeding point at a position B1, and the extension from the position B1 to a position B2 form a planar inverted-F antenna (PIFA) architecture, generating a single-frequency (2.4 GHz) resonance frequency. The dimension of the first antenna 110 is 4 mm in width and 30 mm in length, but not limited thereto.

The second antenna 120 is a Wi-Fi main antenna, and the feeding point is at a position B3. The second antenna 120 includes a primary radiator 122 (at positions B3 and B4) and a secondary radiator 124 (at positions C1 and C2). The primary radiator 122 and the secondary radiator 124 are separated from each other and are both connected to the first ground 130. The secondary radiator 124 is near a feeding end of the primary radiator 122, and the primary radiator 122 and the secondary radiator 124 extend along different directions.

The primary radiator 122 and the secondary radiator 124 jointly constitute an open loop antenna architecture. A change of the path length of the positions C1 and C2 may adjust the impedance matching bandwidth and resonance frequency point position of Wi-Fi 2.4 GHz. A length L10 between the positions C1 and C2 is 17 mm, but not limited thereto. The dimension of the primary radiator 122 of the Wi-Fi main antenna is 20 mm in width and 35 mm in length, but not limited thereto.

The third antenna 140 is a Wi-Fi auxiliary (AUX) antenna, and the feeding point is at a position B5. A path from the position B5 to a position B6 forms a PIFA antenna architecture with dual-frequency antenna characteristics. A change of the path length of the positions B5 and B6 may adjust the resonance frequency point position of Wi-Fi 2.4 GHz. A width L13 of the third antenna 140 is 7 mm to 8 mm, and the length is 25 mm, but not limited thereto.

In this embodiment, the second antenna 120 is located between the first antenna 110 and the third antenna 140. An extension direction D1 of the first antenna 110 is not parallel to an extension direction D2 of the second antenna 120. The extension direction D2 of the second antenna 120 is not parallel to the extension direction D1 of the third antenna 140.

Specifically, an angle θ1 between the extension direction D1 of the first antenna 110 and the extension direction D2 of the primary radiator 122 of the second antenna 120 is between 45 and 75 degrees, but not limited thereto. The angle θ1 between the extension direction D2 of the primary radiator 122 of the second antenna 120 and the extension direction D1 of the third antenna 140 is between 45 and 75 degrees, but not limited thereto. In addition, the extension direction of the first antenna 110 may not be parallel to the extension direction of the third antenna 140, which is not limited to the drawings.

From the above configuration, even if the distance (between 80 mm and 100 mm) between the first antenna 110 and the second antenna 120 and the distance (between 15 mm and 20 mm) between the second antenna 120 and the third antenna 140 are very small, the first antenna 110, the second antenna 120, and the third antenna 140 may still have better isolation between one another.

In addition, it can be seen from FIG. 3 that the first ground 130 is located between the first antenna 110 and the second antenna 120 and is connected to the first antenna 110 and the second antenna 120. The length of the first ground 130 is approximately 100 mm to 110 mm, and a width L14 is approximately 40 mm, but not limited thereto.

The first ground 130 has a first slot 132 near the first antenna 110. The first slot 132 is surrounded by positions A1, A2, A3, and A4. In this embodiment, the length of the first slot 132 is between 12 mm and 15 mm, such as 14.6 mm or 12.8 mm, but not limited thereto. The width of the first slot 132 is between 4 mm and 6 mm, such as 4.9 mm, but not limited thereto.

In this embodiment, the second antenna 120 is separated from the third antenna 140, and a distance L11 between the second antenna 120 and the third antenna 140 is 17.5 mm, but not limited thereto. The second ground 150 is located between the second antenna 120 and the third antenna 140 and is connected to the third antenna 140. The third antenna 140 and the second ground 150 are connected through a copper foil 142. A thickness L12 of the copper foil 142 is 0.5 mm, and a height L17 (FIG. 4) of the copper foil 142 is 6 mm, but not limited thereto.

The second ground 150 is separated from the second antenna 120 and the first ground 130. A distance L16 (FIG. 4) between the second ground 150 and the second antenna 120 is 5 mm. The second ground 150 is, for example, a copper foil. The second ground 150 has a second slot 152. The extension direction D1 of the first slot 132 is parallel to the extension direction D1 of the second slot 152.

The second slot 152 is surrounded by positions A5, A6, A7, and A8. In this embodiment, the length of the second slot 152 is between 22 mm and 26 mm, such as 24 mm. The width of the second slot 152 is between 0.5 mm and 1.5 mm, such as 1 mm, but not limited thereto. A change of the size of the second slot 152 may adjust the isolation between the second antenna 120 and the third antenna 140.

In the antenna module 100 of this embodiment, the first ground 130 located between the first antenna 110 and the second antenna 120 has the first slot 132, and the second ground 150 located between the second antenna 120 and the third antenna 140 has the second slot 152. Through experiments, the above configuration further increases the isolation among the first antenna 110, the second antenna 120, and the third antenna 140.

In addition, the antenna module 100 further includes a first retaining wall 160 and a second retaining wall 162. In this embodiment, the first retaining wall 160 and the second retaining wall 162 are conductive foams, but the types of the first retaining wall 160 and the second retaining wall 162 are not limited thereto.

The first retaining wall 160 is vertically disposed on the first ground 130 and near the first slot 132 and is conducted with the first ground 130. A distance L6 between the first antenna 110 and the first retaining wall 160 is 9 mm, and a thickness L7 of the first retaining wall 160 is 2 mm to 3 mm, but not limited thereto. In this embodiment, the first retaining wall 160 is located between the first antenna 110 and the first slot 132, such as at the positions A1 and A2. In other embodiments, the first slot 132 may also be located between the first antenna 110 and the first retaining wall 160, such as at the positions A3 and A4.

The second retaining wall 162 is vertically disposed on the first ground 130 and near the second antenna 120 and is conducted with the first ground 130. A thickness L9 of the second retaining wall 162 is 2 mm to 3 mm, but not limited thereto.

The first antenna 110 and the second antenna 120 are located on two relatively far sides of the first retaining wall 160 and the second retaining wall 162. The first retaining wall 160 and the second retaining wall 162 may be used to concentrate radiation energy, reduce mutual interference between antennas, and also block the influence of noise sources (not shown) on the substrate 50 (the motherboard) on wireless transmission. In this embodiment, a distance L8 between the first retaining wall 160 and the second retaining wall 162 is 90 mm to 92 mm, but not limited thereto.

Furthermore, in this embodiment, the antenna module 100 further includes a metal member 165, which is disposed on one side of the first ground 130 and is separated from the first ground 130. In this embodiment, the metal member 165 is a heat sink of the electronic device 10 and may be used as a system ground. It can be seen from FIG. 1 that the metal member 165 includes a vertical plate 165*a* and a horizontal plate 165*b*, but the shape of the metal member 165 is not limited thereto.

As shown in FIG. 4, a shielding casing 60 is provided between the horizontal plate 165*b* of the metal member 165 and the first ground 130. The shielding casing 60 is approximately 2 mm to 3 mm in thickness, but not limited thereto. The substrate 50 having the first ground 130 is located on the shielding casing 60, and the shielding casing 60 is located on the metal member 165. The shielding casing 60 has an opening for the first ground 130 to be connected to the metal member 165 by conductive members 163 and 164. The substrate 50 may be coupled to the metal member 165 through the conductive members 163 and 164, screws (not shown) or internal vias, thereby improving the system grounding effect.

In addition, the second ground 150 extends to the metal member 165, and a distance L15 between the third antenna 140 and the metal member 165 is 16 mm, but not limited thereto. The third antenna 140 is coupled to the metal member 165 through the second ground 150.

Figure 5:
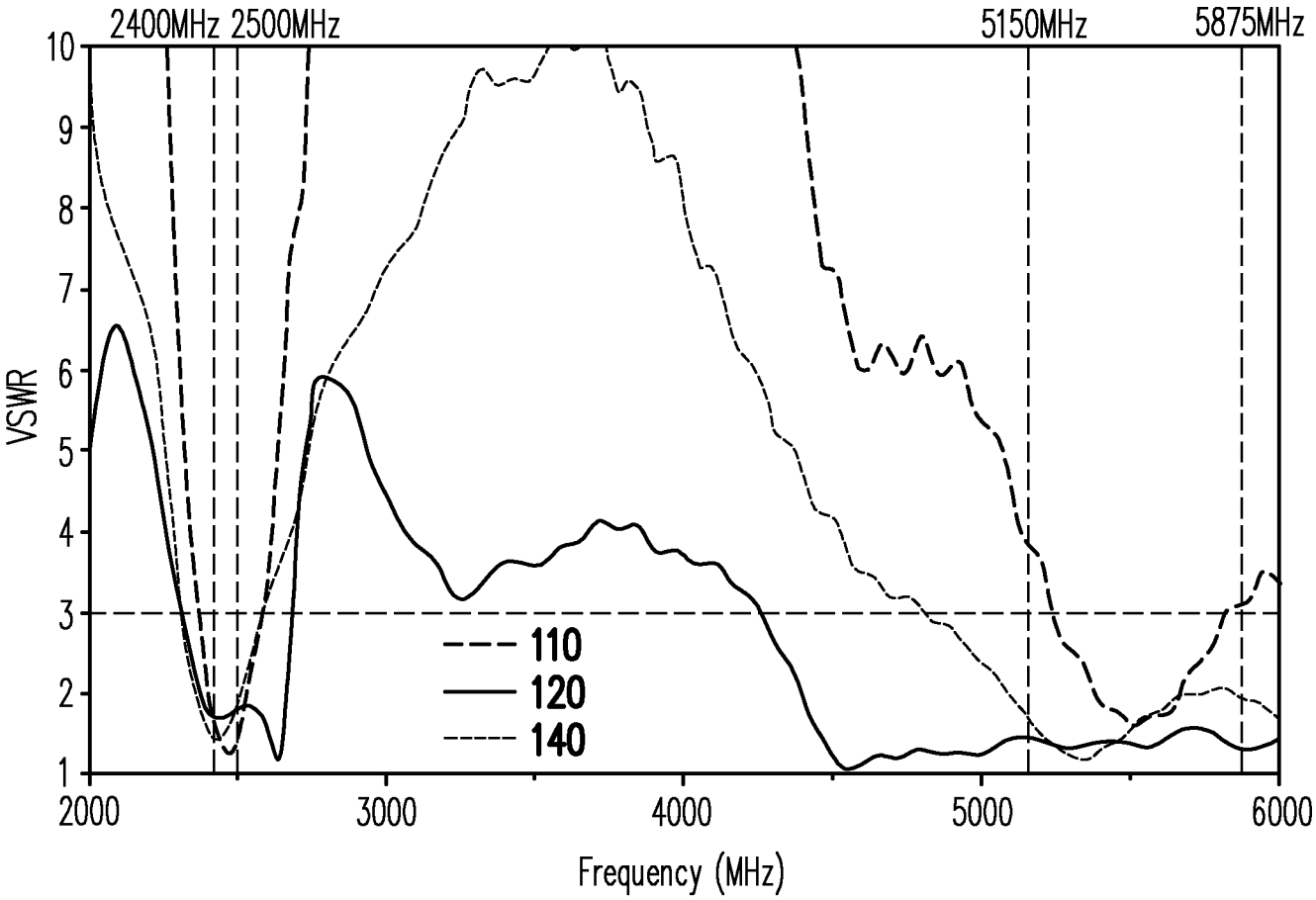
FIG. 5 is a graph of frequency vs. VSWR of the antenna module of FIG. 3.

FIG. 5 is a graph of frequency vs. VSWR of the antenna module of FIG. 3. Please refer to FIG. 5. In this embodiment, VSWR values of the first antenna 110, the second antenna 120, and the third antenna 140 in frequency bands between 2400 MHz to 2500 MHz and 5150 MHz to 5875 MHz are less than 3 so the performance is good.

Figure 6:
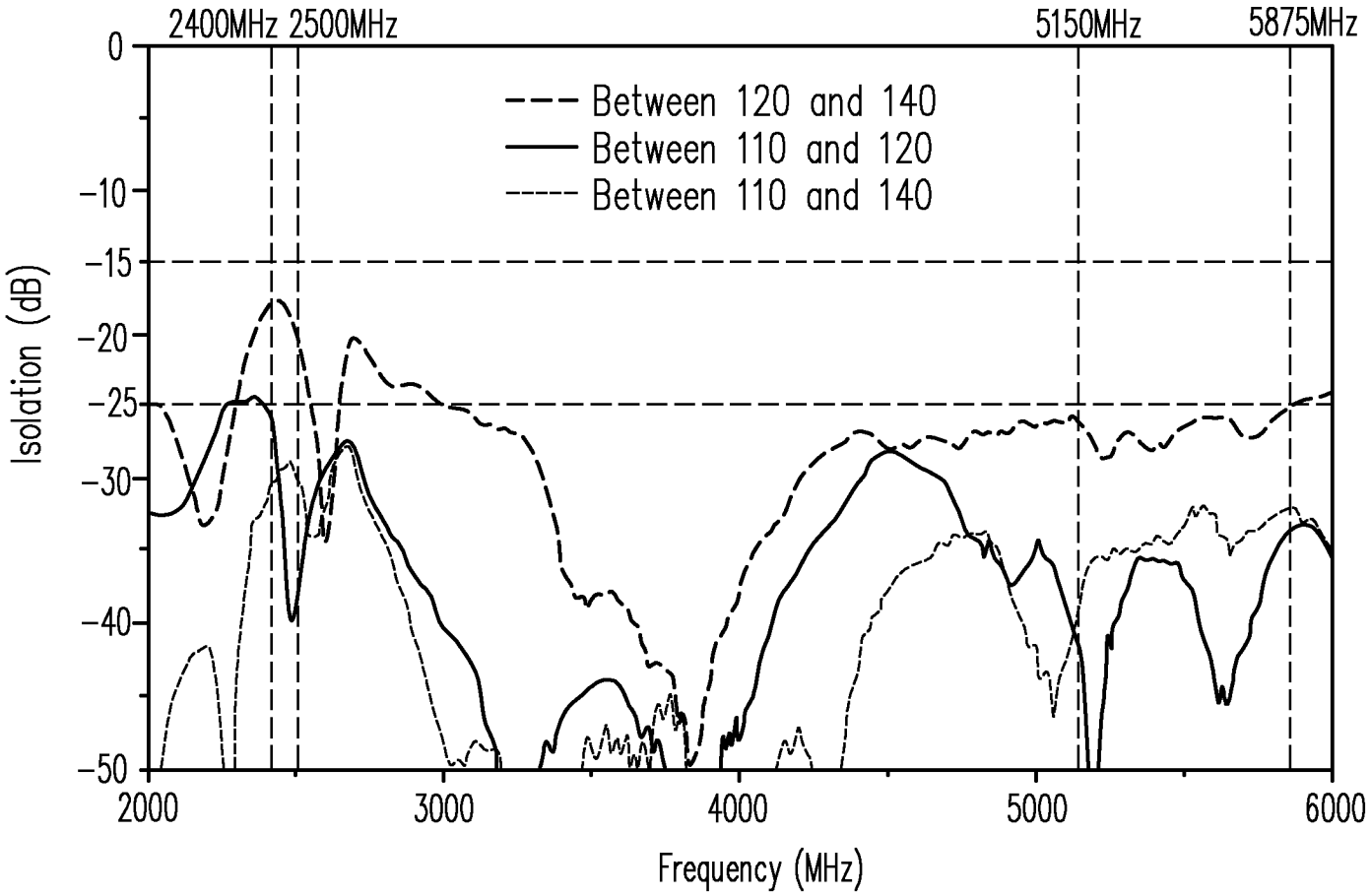
FIG. 6 is a graph of frequency vs. isolation of the antenna module of FIG. 3.

FIG. 6 is a graph of frequency vs. isolation of the antenna module of FIG. 3. Please refer to FIG. 6. In this embodiment, the isolation between the second antenna 120 and the third antenna 140 is −15 dB, and the isolation between the first antenna 110 and the second antenna 120 and the isolation between the first antenna 110 and the third antenna 140 are even lower than −25 dB. Compared with the conventional design where the first antenna 110 and the second antenna 120 are parallelly disposed without the first slot 132 and the isolation between the first antenna 110 and the second antenna 120 is only −10 dB, the isolation of the antenna module 100 of this embodiment has fairly good performance.

Figure 7:
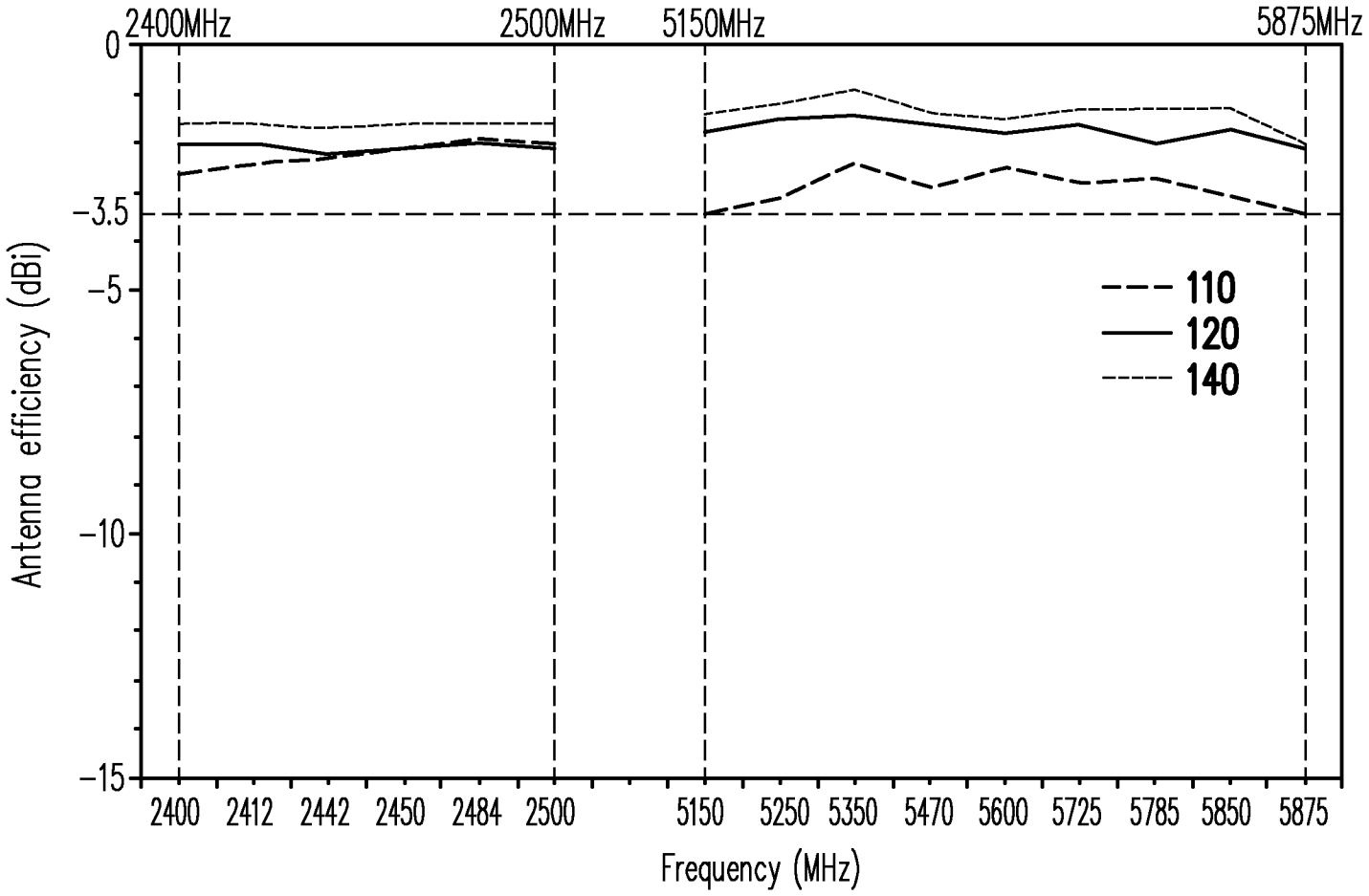
FIG. 7 is a graph of frequency-antenna efficiency of the antenna module of FIG. 3.

FIG. 7 is a graph of frequency vs. antenna efficiency of the antenna module of FIG. 3. Please refer to FIG. 7. In this embodiment, the antenna efficiency of the first antenna 110 is −1.9 dBi to −2.6 dBi in low frequency, and the antenna efficiency is −2.4 dBi to −3.4 dBi in high frequency. The antenna efficiency of the second antenna 120 is −2.0 dBi to −2.2 dBi in low frequency, and the antenna efficiency is −1.4 dBi to −2.1 dBi in high frequency. The antenna efficiency of the third antenna 140 is −1.6 dBi to −1.7 dBi in low frequency, and the high-frequency antenna efficiency is −0.9 dBi to −2.0 dBi in high frequency. In other words, the antenna efficiency may be greater than −3.5 dBi in both 2.4 GHz and 5 GHz frequency band, therefore having good performance. In addition, in this embodiment, the envelope correlation coefficient (ECC) of any two antennas may be within 0.1, therefore having good performance.

Figure 8:
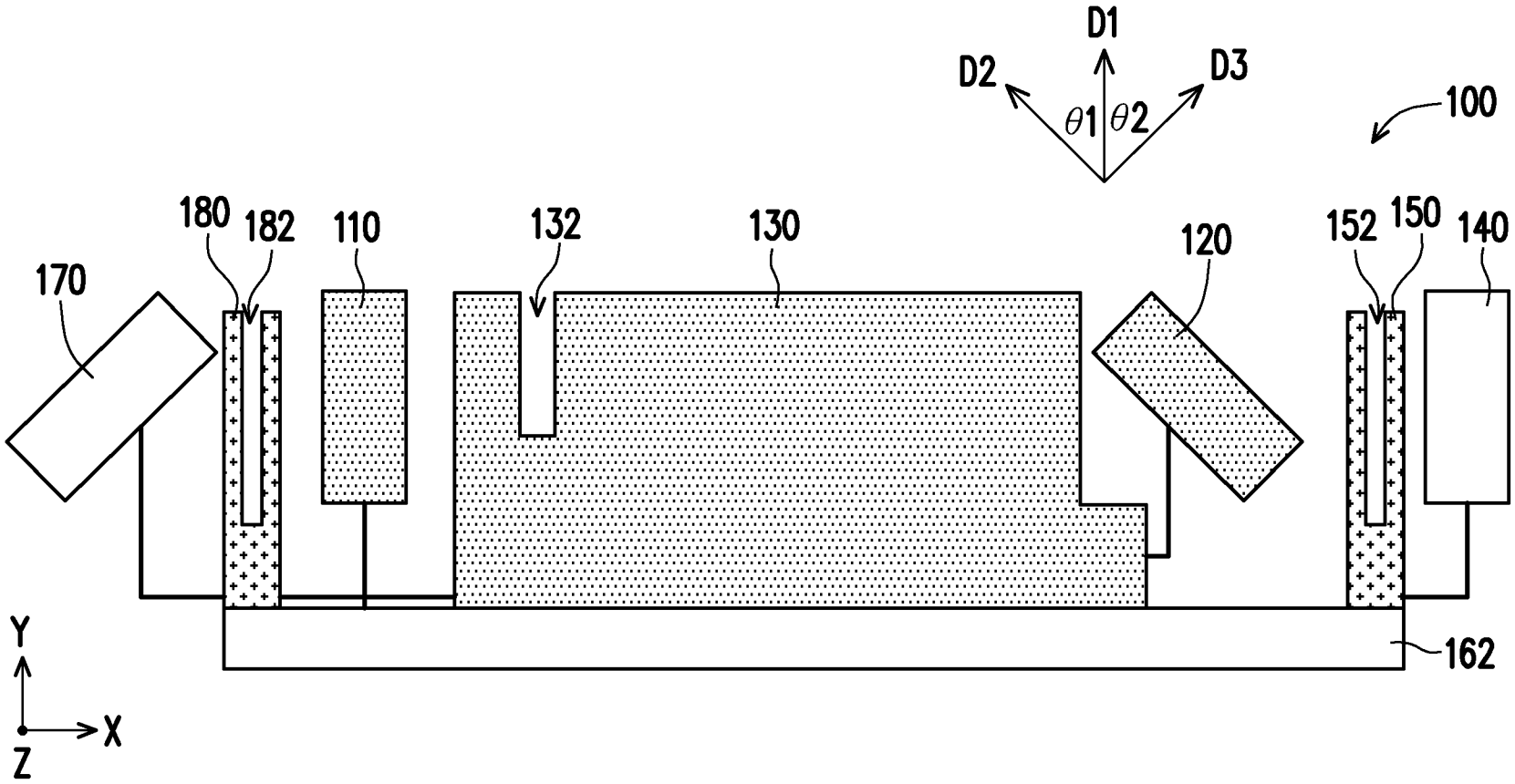
FIG. 8 is a schematic top view of an antenna module according to another embodiment of the disclosure.

In addition, if the existing 5G sub-6G antennas support 4×4 multi-input multi-output (MIMO) multi-antenna configuration, the antennas may be arranged in the manner shown in FIG. 8. FIG. 8 is a schematic top view of an antenna module according to another embodiment of the disclosure. Please refer to FIG. 8. An antenna module 100*a* further includes a fourth antenna 170 and a third ground 180. The first antenna 110 is located between the fourth antenna 170 and the second antenna 120, and an extension direction D3 of the fourth antenna 170 is not parallel to the extension direction D1 of the first antenna 110. An angle θ2 between the extension direction D3 of the fourth antenna 170 and the extension direction D1 of the first antenna 110 is, for example, between 30 degrees and 75 degrees.

The third ground 180 is located between the fourth antenna 170 and the first antenna 110. The third ground 180 is, for example, a copper foil. The fourth antenna 170 extends to the metal member 162 through the third ground 180 and connects to the system ground. The third ground 180 has a third slot 182.

In this embodiment, the first antenna 110 and the second antenna 120 may be printed on the substrate 50 (FIG. 3) and coupled to the metal member 165 through the first ground 130. The third antenna 140 and the fourth antenna 170 may be coupled to the metal member 165 through the second ground 150 and the third ground 180 (independent small circuit boards or copper foils) and transmission lines. The above configuration may enable the first antenna 110 and the fourth antenna 170 to have good isolation and antenna efficiency.

In summary, the extension direction of the first antenna of the antenna module according to the disclosure is not parallel to the extension direction of the second antenna, and the extension direction of the second antenna is not parallel to the extension direction of the third antenna. In addition, the first ground located between the first antenna and the second antenna has the first slot, and the second ground located between the second antenna and the third antenna has the second slot. The above configuration may effectively increase the isolation among the first antenna, the second antenna, and the third antenna, and enable the first antenna, the second antenna, and the third antenna to have good antenna efficiency.

What is claimed is:

1. An antenna module, comprising:

a first antenna;

a second antenna;

a first ground, located between the first antenna and the second antenna, connected to the first antenna and the second antenna, and having a first slot near the first antenna;

a third antenna, wherein the second antenna is located between the first antenna and the third antenna, an extension direction of the first antenna is not parallel to an extension direction of the second antenna, and the extension direction of the second antenna is not parallel to an extension direction of the third antenna;

a second ground, located between the second antenna and the third antenna, connected to the third antenna, being separated from the second antenna and the first ground, and having a second slot;

a first retaining wall, vertically disposed on the first ground and near the first slot and conducted with the first ground; and a second retaining wall, vertically disposed on the first ground and near the second antenna and conducted with the first ground, wherein the first retaining wall and the second retaining wall are located between the first antenna and the second antenna.

2. The antenna module according to claim 1, further comprising:

a metal member, disposed on one side of the first ground and being separated from the first ground, wherein the second ground extends to the metal member, and the first ground is connected to the metal member by a conductive member.

3. The antenna module according to claim 1, wherein the first retaining wall is located between the first antenna and the first slot or the first slot is located between the first antenna and the first retaining wall.

4. The antenna module according to claim 1, wherein the second antenna comprises a primary radiator and a secondary radiator, the primary radiator and the secondary radiator are separated from each other and are both connected to the first ground, the secondary radiator is near a feeding end of the primary radiator, and the primary radiator and the secondary radiator extend along different directions.

5. The antenna module according to claim 4, wherein an angle between the extension direction of the first antenna and an extension direction of the primary radiator of the second antenna is between 45 and 75 degrees, and an angle between the extension direction of the primary radiator of the second antenna and the extension direction of the third antenna is between 45 and 75 degrees.

6. The antenna module according to claim 1, wherein an extension direction of the first slot is parallel to an extension direction of the second slot.

7. The antenna module according to claim 1, wherein a length of the first slot is between 12 mm and 15 mm, a width of the first slot is between 4 mm and 6 mm, a length of the second slot is between 22 mm and 26 mm, and a width of the second slot is between 0.5 mm and 1.5 mm.

8. The antenna module according to claim 1, wherein a distance between the first antenna and the second antenna is between 80 mm and 100 mm, and a distance between the second antenna and the third antenna is between 15 mm to 20 mm.

9. The antenna module according to claim 1, further comprising:

a fourth antenna, wherein the first antenna is located between the fourth antenna and the second antenna, and an extension direction of the fourth antenna is different from the extension direction of the first antenna; and a third ground, located between the fourth antenna and the first antenna, and having a third slot.

* * * * *